United States Patent [19]

Hoeksma

[11] Patent Number: 4,587,506

[45] Date of Patent: May 6, 1986

[54] SAFETY TRANSFORMER

[75] Inventor: Gerben S. Hoeksma, Winterswijk, Netherlands

[73] Assignee: N.V. Nederlandsche Apparatenfabriek NEDAP, De Groenlo, Netherlands

[21] Appl. No.: 682,199

[22] Filed: Dec. 17, 1984

[30] Foreign Application Priority Data

Dec. 22, 1983 [NL] Netherlands ..... 8304414

[51] Int. Cl.[4] ..... H01F 17/06; H01F 27/30

[52] U.S. Cl. ..... 336/178; 336/198

[58] Field of Search ..... 336/178, 165, 198, 208, 336/212

[56] References Cited

FOREIGN PATENT DOCUMENTS 0105541 4/1984 European Pat. Off. .

969130 5/1958 Fed. Rep. of Germany ..... 336/165

105310 8/1980 Japan ..... 336/198

OTHER PUBLICATIONS

"A Single Transformer SRPS Power Supply Operating from the Mains", E. B. G. Nijhof, Second International Powerconversion Conference, Munich, 9/3-5, 1980.

*Primary Examiner*—Thomas J. Kozma

*Attorney, Agent, or Firm*—Fleit, Jacobson, Cohn & Price

[57] ABSTRACT

A safety transformer with low coupling factor, which comprises at least one primary winding mounted on a spool and at least one secondary winding mounted on a spool, and a core including a first section cooperating with the primary winding(s) and a second section cooperating with the secondary winding(s). The first and second core sections have facing ends and all facing ends of these core sections are separated by an isolating means.

7 Claims, 5 Drawing Figures

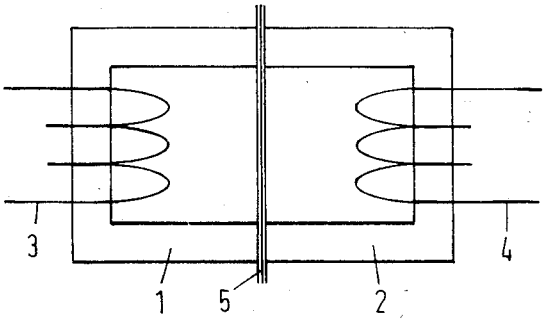
FIG. 1
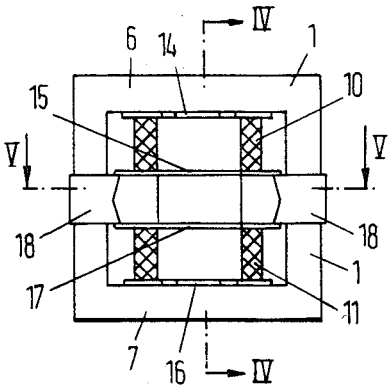
FIG. 2
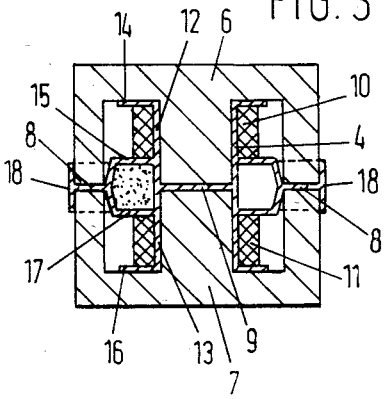
FIG. 3
FIG. 4
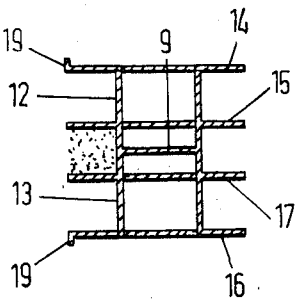
FIG. 5
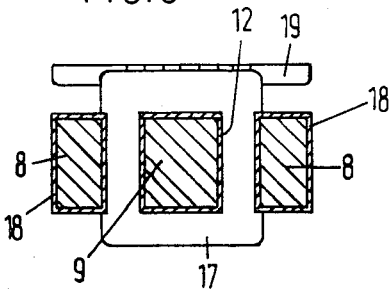

SAFETY TRANSFORMER

The invention relates to a safety transformer with low coupling factor, which comprises at least one primary winding mounted on a spool and at least one secondary winding mounted on a spool, and a core including a first section cooperating with the primary winding(s) and a second section cooperating with the secondary winding(s), which first and second core sections have facing ends.

Such transformers are known per se and can be used, for example, in a converter as disclosed in European patent application No. 83201258.7 or in a Series Resonant Power Supply as disclosed, for example, in Proceedings of the Second International Conference on Power Conversion, pp. 2.8-1 ff.

International standards and recommendations applying to safety transformers, such as those disclosed in publication no. 380 of the International Electrotechnical Commission, prescribe minimum values for the length of leakage and air paths and for the thickness of the isolation in the transformer.

For example, aforesaid publication no. 380 prescribes that a so-called SELV (Safety Extra Low Voltage) winding must be separated from all other windings of the transformer by an isolating barrier. This prescription results in demands as to the thickness of the isolation and the length of the leakage and air paths in the transformer. The isolation thickness is determined by the shortest distance measured through the isolating material between the primary and the secondary circuit of the transformer, the usual isolating jacket of the winding wire being left out of account for considerations of safety.

In the past it was tried to satisfy the demands imposed by providing the isolating barrier between the windings and the core of the transformer. Especially in the case of small transformers designed for print mounting this results in problems to be solved only by additional measures.

In particular, in such small transformers the distance required between, on the one hand, the terminal leads and terminal pins or eyelets and, on the other hand, the transformer core presents a problem that can be solved only by the use of, for example, additional isolating partitions and/or isolating sleeves.

Such additional, special measures result in higher production costs while the final result is largely contingent on the skill of the production personnel.

It is an object of the invention to provide a transformer of the above type which has such a structure that the safety demands can be satisfied in a relatively simple manner without resulting in increased production costs and without the need for imposing high demands on the skill of the production personnel.

To this end, in accordance with the invention a safety transformer of the above type is characterized in that all facing ends of the two core sections are separated by an isolating means.

On account of the steps taken in accordance with the invention, less stringent demands need be imposed on the isolation and the leakage and air paths between the coils and the core and between the terminal leads, pins and eyelets and the core, respectively, as the actual isolating barrier is located between the core sections.

The invention will be described in detail hereinafter with reference to the accompanying drawings showing a number of embodiments, in which drawings:

FIG. 1 illustrates the idea underlying the invention;

FIG. 2 shows in side view an embodiment of a transformer according to the invention;

FIG. 3 shows in sectional view the transformer of FIG. 2 in the same orientation as in FIG. 2;

FIG. 4 shows a sectional view along the line IV—IV in FIG. 2; and

FIG. 5 shows a sectional view along the line V—V in FIG. 2.

FIG. 1 illustrates the idea underlying the invention by schematically showing a tranformer having a frame-shaped core consisting of two U-shaped sections 1 and 2. The primary transformer winding 3 is wound on core section 1 and the secondary transformer winding 4 is wound on core section 2. The ends of the legs of the two U-shaped core sections are mounted in facing relationship so as to form a closed magnetic circuit. If these ends should conventionally be disposed in direct abutment, the core sections would be electrically interconnected too and the required isolation should be located entirely between the windings and the associated core sections. In accordance with the invention, however, isolating material is disposed between the two core sections so as to electrically insulate these section from each other. Consequently, the so-called network separation is provided between the core sections. The isolation disposed between the two core sections is schematically shown at 5.

In this manner, less high demands need be imposed on the isolation of the windings and that of the terminal pins or eyelets and the terminal leads relative to the core.

Self-evidently, the presence of the isolating material between the core sections results in a leakage field, so that this structure is suitable for use only if the transformer need not have a high coupling factor.

It is observed that the invention is applicable too if more than one primary and/or secondary winding is used and if one or various other conventional core configurations is employed.

FIGS. 2–5 schematically show a preferred embodiment of the invention as used in a transformer having its core composed of two E-cores 6 and 7. The free ends of the three legs of the two E-cores are disposed in facing relationship and insulating material designated by 8 and 9 is interposed between each pair of facing legs. The primary coil 10 of the transformer is wound on the centre leg of the E-core 6 and the secondary coil 11 is wound on the centre leg of E-core 7.

The coils 10 and 11 are each wound on a spool 12 and 13 respectively, which spools are fitted on the centre legs of the associated E-cores. Each spool is conventionally provided with two outwardly extending flanges 14, 15 and 16, 17, respectively, for retaining the windings and also for achieving air and leakage paths of sufficient length between each coil and the core as well as between the coils themselves. A space is provided between flanges 15 and 17 so as to keep the windings out of the region between the two core halves, in which region a high intensity field prevails during operation of the transformer. Such a feature is known per se for the prevention of high eddy-current losses.

The two spools are preferably configured as a single, combined spool as shown in FIGS. 3 and 4.

Furthermore, as also shown in FIGS. 3 and 4, the isolating material disposed between the facing ends of the centre legs of E-cores 6 and 7 is preferably in the form of a cross partition mounted within the combined spool halfway the height thereof as an integral part of this spool. In this manner effective separation between the two centre legs is achieved without direct leakage or air paths.

As stated earlier, isolating material is also disposed between the facing ends of the outer legs of the E-cores. This isolating material is preferably in the form of a plate 8 of the same surface area as the facing ends of the legs, which plate is provided with vertical walls extending in both directions from the circumference thereof so as to form cup-like means 18 fitting around the ends of the legs. The plate 8 defining the bottom of these cups isolates the legs from each other while the vertical walls lengthen the leakage and air paths between the ends of the legs.

Cups 18 may be separate elements but, as shown in FIG. 3, are preferably an integral part of the combined spool including partition 9. To this end, the inner walls of the cups facing the spool are preferably connected to the outer rims of flanges 15 and 17. The cups may also be connected to the spool in a different manner, for example by means of a connecting element extending outwardly from the spool in between flanges 15 and 17. However, such a connection is more difficult to realize in an injection moulding process.

It is observed that also the space between flanges 15 and 17 of the combined spool may be filled with isolating material, resulting in the achievement of a solid combined flange to which the cups 18 can be formed. This possibility is shown in the left-hand parts of FIGS. 3 and 4 by dots.

FIGS. 4 and 5 show portions 19 formed to one edge of each flange 14 and 16, which portions 19 are integral with these flanges and serve as supports for the transformer and further have openings therein for receiving terminal pins and/or eyelets to which the ends of the windings can be soldered or otherwise attached.

The assembling of a transformer according to the invention is performed as follows. After the spools, the isolating partitions and the cups have been manufactured by injection moulding either as separate components or as an integral unit, the coils are mounted thereon.

The core halves are subsequently mounted by fitting the legs thereof in the spool(s) and the cups in the manner shown in FIGS. 2 and 3, after which, if desired, the transformer may additionally be provided with an enclosure.

As stated earlier, the invention can also be applied to transformers having cores of a different shape. Such cores may require a modification of the member shown in the drawings which serves as the combined spool and as the isolating means disposed between the core sections, while it may appear impossible to use such a member in integral form. Such modifications, however, will be obvious to the worker in the art who has taken notice of the above and are considered to fall within the scope of the present invention.

It is observed that a transformer according to the invention will well withstand high temperatures occuring under overload conditions. In fact, heat generated in the coils can only indirectly, i.e., via the legs of the core, reach the isolating material separating these legs, so that a major part of this heat will be discharged via the core. As a result, even under overload conditions the chances of an adverse effect of the temperature on the safety isolation or even of breakdown will be very small.

I claim:

1. An integral one-piece spool for a safety transformer with a low coupling factor, which comprises a first spool portion for supporting a primary winding on the spool, a second spool portion for supporting a secondary winding on the spool, outwardly extending outer flanges adjacent opposite ends of the spool, outwardly extending inner flanges adjacent an inner portion of the spool, each of the outer and inner flanges defining an end of a respective one of the first and second spool portions and the inner flanges being spaced apart to define an isolating space between the first and second spool portions, cup defining portions on opposite sides of the spool, each of the cup-defining portions being integral with at least one of the inner flanges and projecting outwardly therefrom, and each of the cup defining portions including a pair of deep isolating cups for receiving leg end portions of associated transformer core members, with each pair of deep isolating cups being defined by an isolating plate located essentially centrally with respect to the spaced inner flanges and having walls extending from the isolating plate in opposite directions for a distance essentially corresponding at least to a distance defined by the isolating space between the spaced inner flanges.

2. The integral one-piece spool as recited in claim 1, which further comprises isolating material disposed in the isolating space between the spaced inner flanges.

3. The integral one-piece spool as recited in claim 1, which further comprises a spool-and-terminal support member integrally formed on each of the outer flanges.

4. The integral one-piece spool as recited in claim 2, which further comprises a spool-and-terminal support member integrally formed on each of the outer flanges.

5. The integral one-piece spool as recited in claim 1, which further comprises transformer core member leg-receiving portions in each of the first and second spool portions separated by an isolating partition located centrally with respect to the spaced inner flanges.

6. The integral one-piece spool as recited in claim 5, in combination with a primary winding on the first spool portion, a secondary winding on the second spool portion, and a pair of opposed E-shaped core members mounted on the spool, said E-shaped core members having center legs extending within the leg-receiving portions of the respective ones of the first and second spool portions and having outer legs having end portions received in respective ones of the deep isolating cups.

7. The combination as recited in claim 6, which further comprises isolating material disposed in the isolating space between the spaced inner flanges.

* * * * *